US005185912A

United States Patent [19]

Yunoki

[11] Patent Number: 5,185,912

[45] Date of Patent: Feb. 16, 1993

[54] METHOD AND GUIDE DEVICE FOR SLIDE FASTENER CHAIN WITH CLOTH PIECES ATTACHED

[75] Inventor: Akio Yunoki, Toyama, Japan

[73] Assignee: Yoshida Kogyo K. K., Tokyo, Japan

[21] Appl. No.: 739,247

[22] Filed: Aug. 1, 1991

[30] Foreign Application Priority Data

Aug. 7, 1990 [JP] Japan ..... 2-83482

[51] Int. Cl.[5] ..... B21D 53/50

[52] U.S. Cl. ..... 29/408; 29/766

[58] Field of Search ..... 29/766–768, 29/33.2, 408

[56] References Cited

U.S. PATENT DOCUMENTS 3,530,563 9/1970 Maeda ..... 29/767

3,993,724 11/1976 Takamatsu ..... 29/766

4,606,100 8/1986 Yunoki et al. ..... 29/767

FOREIGN PATENT DOCUMENTS 2173253 10/1986 United Kingdom ..... 29/408

*Primary Examiner*—P. W. Echols

*Attorney, Agent, or Firm*—Hill, Steadman & Simpson

[57] ABSTRACT

A guide device for guiding a slide fastener chain with cloth pieces attached to opposed fastener tapes of the chain. The guide device is adapted to be located near and upstream of a discharge unit for discharging the slide fastener chain with the cloth pieces attached to the opposed fastener tapes. The guide device comprises a pair of guide arms extending perpendicularly to a travelling path of the slide fastener chain, the guide arms extending horizontally toward each other for engaging the attaching portions of the cloth pieces.

8 Claims, 4 Drawing Sheets

METHOD AND GUIDE DEVICE FOR SLIDE FASTENER CHAIN WITH CLOTH PIECES ATTACHED

BACKGROUND OF THE INVENTION

1. Field of the Invention:

This invention relates to a guide device for smoothly guiding, toward a discharge port, a slide fastener chain to which a plurality of pieces of cloth (cut into a predetermined shape for a clothing, a bed cover, a bed sheet, a bag, etc.) are sewn longitudinally along opposite fastener tapes.

2. Description of the Related Art:

As shown in FIG. 2(A) of the accompanying drawings, in an apparatus for producing slide fasteners attached to pieces of cloth, a chain FC travels toward a discharge port 5. A number of pieces of cloth cut into a predetermined shape are fed to a discharge port 5, and are sewn successively to a slide fastener chain (hereinafter also called "chain") 1 along opposite fastener tapes by a sewing machine.

As shown in FIG. 2(B) of the accompanying drawings, a slide fastener chain FC to which the successive cloth pieces are sewn along the opposite fastener chain is severed transversely at longitudinally spaced positions between adjacent ends of the successive cloth pieces. Then a bottom end stop, a slider and a pair of top end stops are mounted on the chain FC, whereupon the resulting chain is fed to a discharge port 5. This guide device is located on the path of the chain FC toward the discharge port 5.

In general, the chain FC with the cloth pieces is discharged horizontally, and hence the cloth pieces sewn to the chain 1 hang down from the opposite sides of the chain 1 so that due to the weight of the cloth pieces the chain 1 would be displace laterally until they reach the discharge port. Consequently the cloth pieces attached to the chain are difficult to discharge in order.

Particularly in the case where the sewing maching M is located upstream of the discharge port 5 as shown in FIG. 2(A), precise sewing of the cloth pieces onto the chain 1 cannot be achieved due to the lateral displacement. In the case where the cutting unit C is located upstream of the discharge port 5 as shown in FIG. 2(B), precise cutting of the chain 1 cannot be achieved due to the lateral displacement.

As a result, the products can be discharged only disorderly, thus impeding the product flow to a subsequent stage of production.

A proposal has been made as disclosed in, for example, U.S. Pat. No. 4,606,100. According to this prior art, the discharge port is composed of a pair of vertically opposed rollers, at least one of which has on its peripheral surface an annular groove for guiding the interengaged rows of coupling elements of the chain in an attempt to prevent the chain from being laterally displaced.

However, the foregoing prior discharge devices have the following problems:

With this prior arrangement, the above-described lateral displacement cannot be eliminated perfectly so that the products can be discharged downstream of the discharge port in an orderly manner.

Further, in the case where the individual cloth piece is attached to the longitudinal edge of one of the fastener tape so as to cover the surface of the coupling element rows, the chain together with part of the cloth would be sandwiched between the discharge rollers during discharging, thus potentially preventing orderly discharge.

SUMMARY OF THE INVENTION

It is therefore an object of this invention to provide a guide device in which an ordinary slide fastener chain and even a slide fastener chain with successive cloth pieces attached thereto so as to cover the opposed coupling element rows can be guided to a discharge unit orderly.

According to a first aspect of the invention, there is provided a guide device for guiding a slide fastener chain with cloth pieces attached to opposed fastener tapes of the chain, wherein the guide device is adapted to be located near and upstream of a discharge unit for discharging the slide fastener chain with the cloth pieces attached to the opposed fastener tapes, the guide device comprising a pair of guide arms extending perpendicularly to a travelling path of the slide fastener chain, the guide arms extending horizontally toward each other.

Preferably, the guide device may further include restricting means for guiding the chain so as to restrict vertical movement of the chain, the restricting means including upper and lower plates adapted to be located upwardly and downwardly, respectively, of the chain.

Each of the guide arms has an inwardly directed end position which is pivotally movable upwardly from its horizontal posture.

In addition, each of the guide arms is longitudinally adjustably located.

With this arrangement, immediately before the chain with the successive cloth pieces attached thereto reaches the discharge unit in the form of mating rollers, the opposite guide arms of the guide device enter between the fastener tape edges and the cloth pieces until each guide arm reaches the sewn portion, thus preventing lateral displacement of the chain.

At that time, the restricting means restricts the upper and lower limit positions of the chain, keeping the chain in a horizontal posture.

If the guide device is located near and upstream of the discharge unit, even a slide fastener chain with the cloth pieces attached thereto so as to cover the opposed coupling element rows can be dischaged to a subsequent stage of production in order, with no lateral displacement.

BRIEF DESCRIPTION OF THE DRAWINGS

FIGS. 2(*c*) and 2(*d*) are schematic views of systems incorporating the present invention.

DETAILED DESCRIPTION

Figure 1:
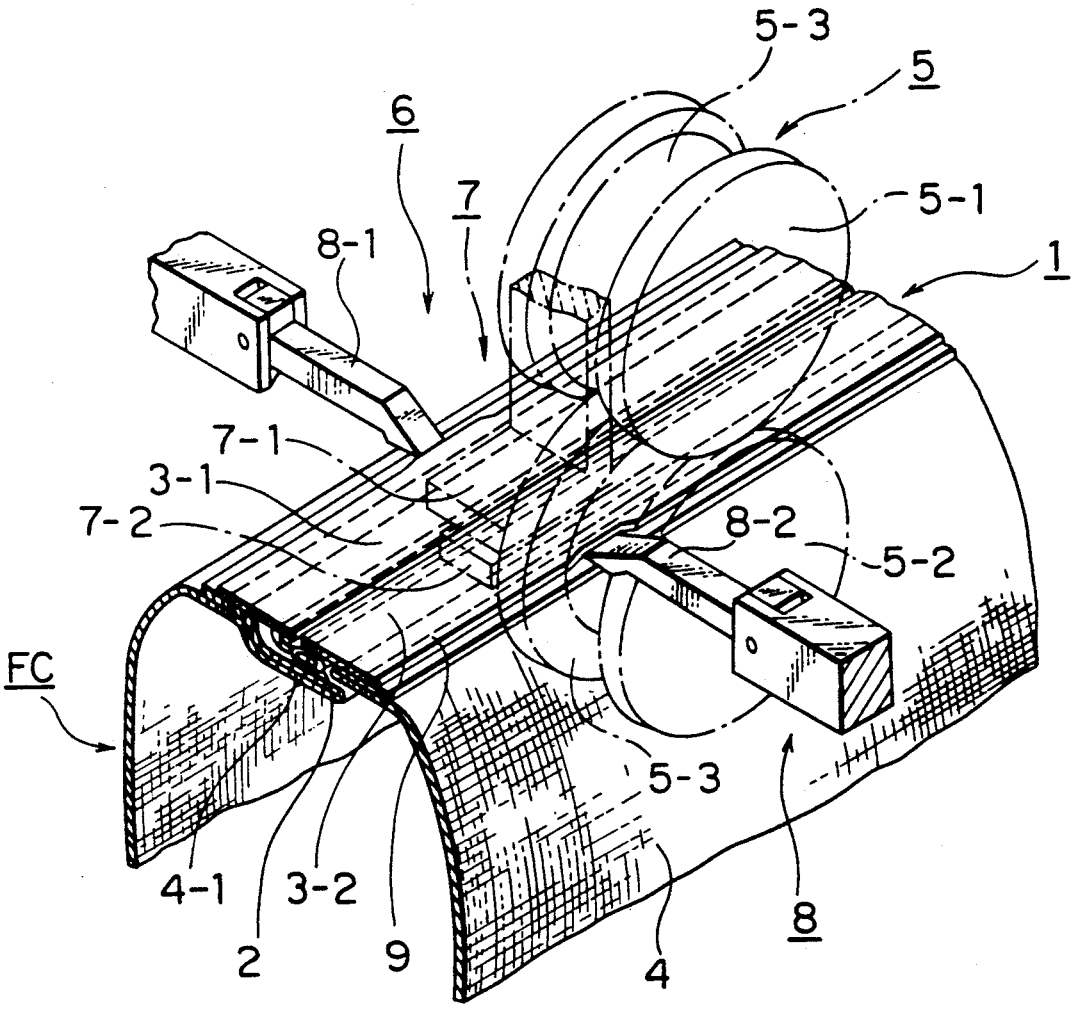
FIG. 1 is a perspective view of a guide device embodying this invention.
Figure 2A:
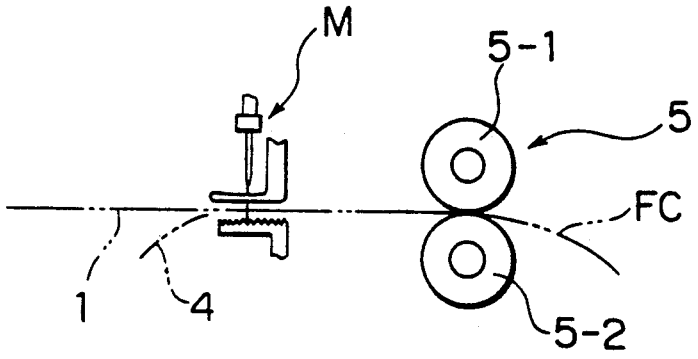
FIG. 2A (PRIOR ART)
FIG. 2(*a*) and 2(*b*) are schematic views showing different examples of background art.
Figure 2B:
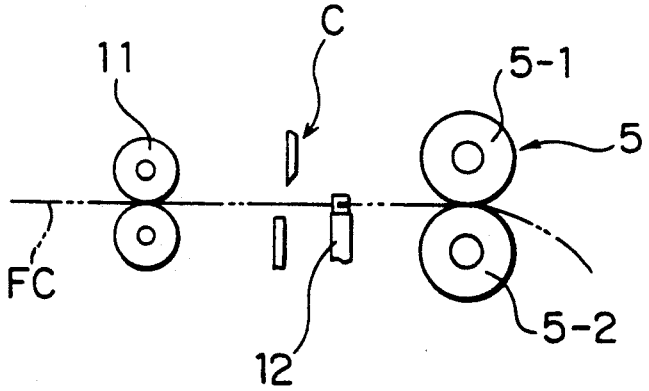
FIG. 2B (PRIOR ART)
Figure 2C:
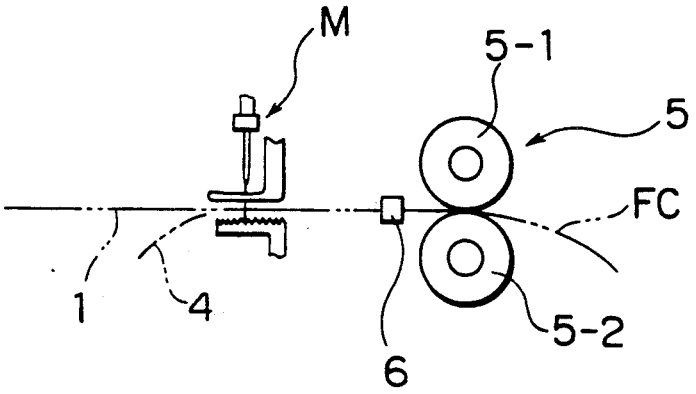
Figure 2D:
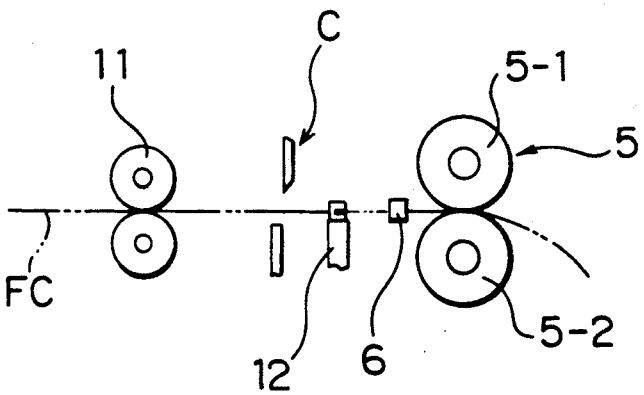

The principles of this invention are particularly useful when embodied in a guide device such as shown in FIG. 1, generally designated by the numeral 6.

As shown in FIG. 1, a plurality of pieces of cloth 4 sewn to and along the opposite fastener tapes 3-1, 3-2 of a slide fastener chain 1 are guided by the guide device 6 as they are discharged successively to a subsequent stage of production.

In FIG. 1, reference numeral 1 designates the chain including a pair of opposed fastener tapes 3-1, 3-2 carrying on their inner longitudinal edges a pair of interengaged coupling element rows 2. To the lower surface of the longitudinal edge of each fastener tapes 3-1, 3-2, the cloth pieces 4 are sewn by a sewing machine M. These resulting semi-products are fed to a discharge unit 5 and are then discharged from the discharge unit 5 to a subsequent stage of production. As shown in FIG. 2(*c*), the sewing maching M is located upstream of the discharge unit 5 and sews the cloth pieces 4 successively to the chain 1 and feeds them to the discharge unit 5 via the guide device 6.

In the embodiment of FIG. 1, the cloth pieces 4 and the chain 1 are discharged simply as shown in FIG. 2(*c*) while the cloth pieces 4 are successively sewn to the chain 1. As shown in FIG. 2(B), the chain FC to which the cloth pieces 4 are attached is severed perpendicularly to the travelling path of the chain FC by a cutting unit C as it is supplied from a pair of supply rollers 11 to the discharge unit 5. Then a slider 12 is threaded on the chain 1, and top and bottom end stops are attached to the chain 1 to make up a slide fastener. This guide device can be applied to a slide fastener manufacturing apparatus in which the chain is fed continuously to the discharge unit 5.

The discharge unit 5 includes a pair of vertically opposed discharge rollers 5-1, 5-2, at least one of which has an annular groove 5-3 centrally in the peripheral surface. In the illustrated embodiment, since the surface of the opposed coupling element rows 2 are covered by folded edges 4-1 of the successive cloth pieces 4 associated with one of the fastener tapes, each of the discharge rollers 5-1, 5-2 has a annular groove 5-3 so that both the opposed coupling element rows 2 and the folded edges of the successive cloth pieces 4 of the chain FC pass through the two grooves 5-3, 5-3.

The guide device 6 of this embodiment comprises a restricting means 7 for guiding the chain FC with the cloth pieces 4 so as to retrict the vertical movement of the chain FC, and a guiding means 8 for guiding the chain FC so as to restrict the lateral displacement of the chain FC. The restriction means 7 is mechanically separate from the guide device 6.

The restricting means 7 is located near and upstream of the discharge unit 5 and includes an upper pressure plate 7-1 and a lower support plate 7-2 spaced from the upper pressure plate 7-1 by a distance exactly necessary for the chain 1 and the folded edges 4-1 of the cloth pieces 4 to pass through. In addition, each of the upper pressure plate 7-1 and the lower support plate 7-2 has a width such that each plate can accommodate the associated fastener tape 3-1, 3-2 and the sewn thread 9.

The guide means 8 includes a pair of guide arms 8-1, 8-2 extending horizontally toward each other. Each guide arm 8-1, 8-2 extends prependicularly to the traveling path of the chain FC and terminates in a wedge-shaped end facing the gap between the upper pressure plate 7-1 and the lower support plate 7-2. The position of the wedge-shaped end is set so as to be between the fastener tapes 3-1, 3-2 and the cloth pieces 4, at the stitching line of the chain FC, i.e. near the sewn thread 9. In order to meet a variety of possible widths of the chain 1, the distance between the inner confronting ends of the two guide arm 8-1, 8-2 is preferably adjustable. Further, preferably the wedge-shaped end of each guide arm 8-1, 8-2 is pivotally movable upwardly from a horizontal position about the base end so that the guide device 8 can be set with ease while the slide fastener manufacturing apparatus is operating.

Figure 3:
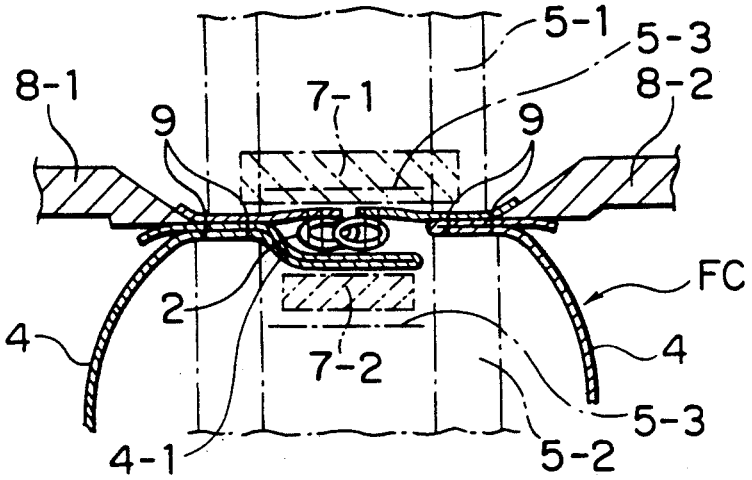
FIGS. 3 through 5 are cross-sectional views showing different manners in which the chain is guided.
Figure 4:
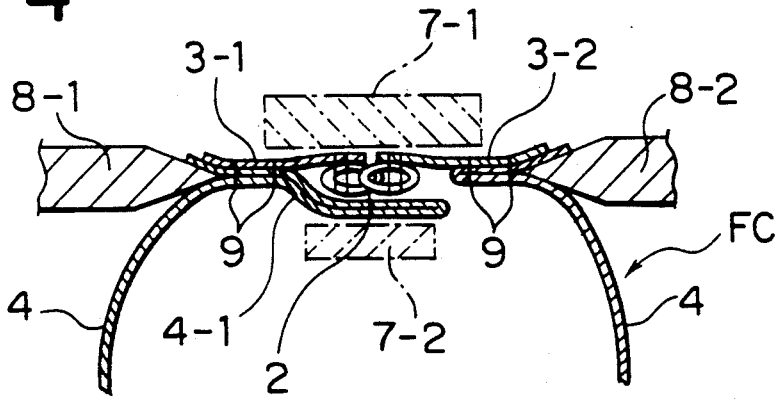
Figure 5:
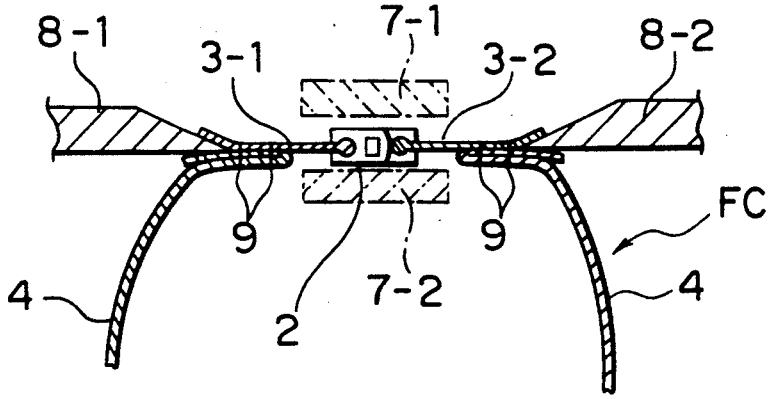

The mode of use and operation of the guide device will now be described with reference to FIGS. 3 through 5. FIGS. 3 and 4 show the manner in which the chain having coiled coupling elements and folded edges of the cloth pieces is guided. FIG. 5 shows the manner in which the chain having metallic or synthetic resin molded coupling elements and the cloth pieces with no folded edges is guided.

When the chain FC supplied from the upstream side to the discharge unit 5 enters the guide device, the chain FC with or without the folded cloth edges passes through the gap between the upper pressure plate 7-1 and the lower support plate 7-2 and is guided horizontally. At the same time, as shown in FIGS. 3 and 5, each of the guide arms 8-1, 8-2 is inserted between the sewing margin of the respective fastener tape 3-1, 3-2 and that of the individual cloth pieces 4 and guides the respective fastener tape 3-1, 3-2 from its outside.

In the case shown in FIG. 4, each guide arm 8-1, 8-2 is inserted between the sewing margin of the associated cloth piece 4 and the main part of the same cloth piece 4 while the chain FC is guided horizontally from opposite directions.

Thus the chain FC with the cloth pieces is guided horizontally from opposite directions as well as vertically from opposite directions by the guide device 6 so that the chain FC can be discharged passing through the discharge rollers 5-1, 5-2 accurately in an orderly manner, without lateral displacement.

With the guide device of this invention, since the chain with the cloth pieces is accurately guided keeping horizontally from opposite directions at a position immediately upstream of the discharge rollers, the chain with the cloth pieces sewn to the fastener tapes so as to cover the coupling element rows can be discharged orderly to the downstream side via the discharge unit, without lateral displacement, thus improving the working efficiency in a subsequent stage of production without impairing the value of products.

Since the guide device of this invention comprises simple guide arms which maintain the fastener tape edges of the chain horizontally from opposite directions, the guide device can be installed with maximum ease.

What is claimed is:

1. In an apparatus for producing slide fastener chains with cloth pieces attached to opposed fastener tapes of the chain, said apparatus including a discharge unit for discharging the fastener chains attached to cloth pieces from said apparatus, a guide device, positioned upstream of said discharge unit, for guiding the slide fastener chains after said cloth pieces have been attached to said fastener chains, said guide device comprising:

a pair of guide arms extending perpendicularly to a traveling path of said slide fastener chain, said guide arms extending horizontally toward each other; and restricting means for guiding the chain so as to restrict vertical movement of the chain, said restricting means including upper and lower plates located upwardly and downwardly, respectively, of the chain;

whereby, during operating of said apparatus, said guide arms extend between said fastener tapes and said cloth pieces.

2. A guide device according to claim 1, wherein each of said guide arms has an inwardly directed end portion which is pivotally movable upwardly from its horizontal posture.

3. A guide device according to claim 2, wherein the distance between the inner confronting ends of said guide arms is adjustable.

4. A guide device according to claim 1, wherein the distance between the inner confronting ends of said guide arms is adjustable.

5. A guide device according to claim 1, wherein each of said guide arms has an inwardly directed end portion which is pivotally movable upwardly from its horizontal posture.

6. A guide device according to claim 5, wherein the distance between the inner confronting ends of said guide arms is adjustable.

7. A guide device according to claim 1, wherein the distance between the inner confronting ends of said guide arms is adjustable.

8. In producing slide fastener chains with cloth pieces attached to opposed fastener tapes of the chain, a method of guiding the slide fastener chains after said clothes pieces have been attached to said fastener chains, said method comprising the following steps:

providing a discharge unit for discharging the fastener chains attached to cloth pieces;

causing said fastener chain with said cloth pieces attached thereto to move along a traveling path;

providing a guide device disposed upstream of said discharge unit, said guide device including a pair of guide arms extending perpendicularly to said traveling path of said slide fastener chain, said guide arms extending horizontally toward each other; and positioning said guide arms between said fastener tapes and said cloth pieces while said fastener chain with said cloth pieces attached is moving along said traveling path.

* * * * *